US006543672B2

(12) United States Patent
Hirota et al.

(10) Patent No.: US 6,543,672 B2
(45) Date of Patent: Apr. 8, 2003

(54) METHOD OF FORMING VACUUM CHAMBER OF CONTROL VALVE FOR VARIABLE CAPACITY COMPRESSOR

(75) Inventors: Hisatoshi Hirota, Tokyo (JP); Shiniji Saeki, Tokyo (JP); Kouji Habu, Tokyo (JP)

(73) Assignee: TGK Co., Ltd., Tokyo (JP)

( * ) Notice: Subject to any disclaimer, the term of this patent is extended or adjusted under 35 U.S.C. 154(b) by 0 days.

(21) Appl. No.: 09/873,472

(22) Filed: Jun. 4, 2001

(65) Prior Publication Data

US 2001/0050304 A1 Dec. 13, 2001

(30) Foreign Application Priority Data

Jun. 7, 2000 (JP) ..... 2000-170214

(51) Int. Cl.[7] ..... B23P 15/00; B21K 1/18; B23K 31/02

(52) U.S. Cl. ..... 228/175; 228/177; 228/124.6; 228/226; 228/218; 73/754; 29/888.044; 29/888.02

(58) Field of Search ..... 228/175, 122.1, 228/124.6, 176, 177, 225, 226, 245, 218, 221; 29/888.044, 888.042, 888.02; 73/35.09, 700, 715, 754, 722

(56) References Cited

U.S. PATENT DOCUMENTS 4,357,825 A * 11/1982 Yamaguchi et al. ..... 73/35.09
4,834,340 A * 5/1989 Girdley ..... 137/315.4
4,930,353 A * 6/1990 Kato et al. ..... 338/4
5,628,206 A * 5/1997 Baba ..... 165/76
5,863,023 A * 1/1999 Evans et al. ..... 137/614.21
5,996,899 A * 12/1999 Watanabe et al. ..... 236/92 B
6,105,928 A * 8/2000 Ise et al. ..... 251/118
6,176,137 B1 * 1/2001 Sasaki et al. ..... 73/754

FOREIGN PATENT DOCUMENTS

JP 05039875 A 2/1993

* cited by examiner

*Primary Examiner*—Tom Dunn
*Assistant Examiner*—L. Edmondson
(74) *Attorney, Agent, or Firm*—Patterson, Thuente, Skaar & Christensen, LLC

(57) ABSTRACT

A vacuum chamber-forming method for forming a vacuum chamber in a power element of a control valve for a variable capacity compressor through a reduced number of steps. A power element is assembled in the atmospheric air by arranging a disk, a diaphragm, a disk, a spring and an upper housing on a lower housing, caulking the periphery of the lower housing to the periphery of the upper housing, and then soldering the junction of the upper and lower housings. The assembled power element is placed in a vacuum container, and a small hole formed in the upper housing is subjected to spot welding in the vacuum atmosphere, whereby the small hole is sealed by a weld metal.

10 Claims, 7 Drawing Sheets

METHOD OF FORMING VACUUM CHAMBER OF CONTROL VALVE FOR VARIABLE CAPACITY COMPRESSOR

BACKGROUND OF THE INVENTION (1) Field of the Invention

This invention relates to a method of forming a vacuum chamber of a control valve for a variable capacity compressor, and more particularly to a method of forming a vacuum chamber of an internal variable control valve arranged in a variable capacity compressor for compressing low-temperature/low-pressure refrigerant gas within a refrigeration cycle of an air conditioning system for an automotive vehicle, the variable control valve controlling the quantity of the refrigerant gas to be compressed.

(2) Description of the Related Art

In an air conditioning system installed on an automotive vehicle, control of refrigerating capacity in response to a load is performed by varying the capacity of a compressor, since the rotational speed of the engine as a drive source is not constant. Methods of varying the capacity of a compressor include an internal variable control method in which the capacity of a compressor is controlled exclusively within the compressor and an external variable control method in which the capacity of a compressor is electrically controlled based on the results of arithmetic operation performed in response to output signals from various sensors. Description will now be made of a control valve for a variable capacity compressor, which performs the internal variable control.

FIG. 7 is a cross-sectional view showing an example of the construction of a control valve of the internal variable control type, for a variable capacity compressor, which is manufactured by a conventional manufacturing method.

The control valve for a variable capacity compressor is comprised of a valve 1 and a power element 2 for driving the valve. The valve 1 has a port 4 formed in an end portion of a body 3, for communication with a discharge chamber in the variable capacity compressor so as to introduce discharge pressure Pd, a port 5 formed for communication with a crankcase in the variable capacity compressor so as to deliver control pressure, i.e. crankcase pressure Pc, and a port 6 formed for communication with a suction chamber of the variable capacity compressor so as to receive suction pressure Ps. Further, the valve 1 has a ball valve 7 arranged therein such that the ball valve 7 can be seated on a valve seat formed in a refrigerant passage communicating between the port 4 for introducing the discharge pressure Pd and the port 5 for delivering the crankcase pressure Pc, by being urged away from the port 4. The ball valve 7 is urged in the valve closing direction by a spring 8. Spring load by the spring 8 is adjusted by an adjustment screw 9 screwed in the port 4. Further, a shaft 10 axially movably extends along the axis of the body 3, for driving the ball valve 7 through the port 5 on a downstream side of the ball valve 7.

The power element 2 is comprised of a lower housing 11 combined with the body 3 of the valve 1, an upper housing 12, a diaphragm 13 arranged as a pressure-sensitive member in a manner dividing a space enclosed by the lower housing 11 and the upper housing 12, a pair of disks 14, 15 in a manner sandwiching the same, and a spring 16 urging the disk 15 toward the valve 1. The valve-side disk 14 is held in contact with an end face of the shaft 10 extending through a communication hole 17 that communicates between the port 6 for receiving the suction pressure Ps and a valve-side diaphragm chamber.

The upper housing 12 is provided with a capillary tube 18 for evacuating a space or chamber enclosed by the upper housing 12 and the diaphragm 13. The capillary tube 18 is welded in advance to the top portion of the upper housing 12 such that it communicates with a hole formed therethrough. After evacuation of the chamber through the capillary tube 18 is completed, the capillary tube 18 is crushed and cut off, followed by brazing the end of the remaining portion thereof. The end of the capillary tube 18 is thus sealed, whereby the chamber enclosed by the upper housing 12 and the diaphragm 13 becomes a vacuum chamber to prevent changes in temperature and atmospheric pressure from affecting the operation of the diaphragm 13.

However, the conventional control valve for a variable capacity compressor suffers from a problem that the vacuum chamber within the power element is formed through the lots of steps of processing and assembling the power element, welding the capillary tube to the communication hole formed through the upper housing, connecting an evacuator device to the capillary tube to thereby carry out evacuation, crushing and provisionally sealing the capillary tube, cutting off an evacuator device-side portion of the provisionally-sealed capillary tube, and finally brazing the cut portion.

SUMMARY OF THE INVENTION

The present invention has been made in view of the above problem and an object thereof is to provide a method of forming a vacuum chamber of a control valve for a variable capacity compressor, the method being capable of forming the vacuum chamber in a power element of the control valve through a reduced number of steps.

To accomplish the above object, according to the present invention, there is provided a method of forming a vacuum chamber of a control valve for a variable capacity compressor, said control valve having a pressure-sensitive member separating said vacuum chamber from another chamber, said pressure-sensitive member controlling an opening degree of said control valve in response to suction pressure of said variable capacity compressor introduced into said another chamber. This method comprises the following steps: joining a periphery of a first housing formed with a small hole and defining said vacuum chamber and a periphery of a second housing to be combined with a valve to each other by caulking, and then brazing a junction of said peripheries; and sealing said small hole in a vacuum atmosphere.

The above and other objects, features and advantages of the present invention will become apparent from the following description when taken in conjunction with the accompanying drawings which illustrate preferred embodiments of the present invention by way of example.

DESCRIPTION OF THE PREFERRED EMBODIMENTS

The present invention will now be described in detail with reference to drawings showing preferred embodiments thereof.

Figure 1:
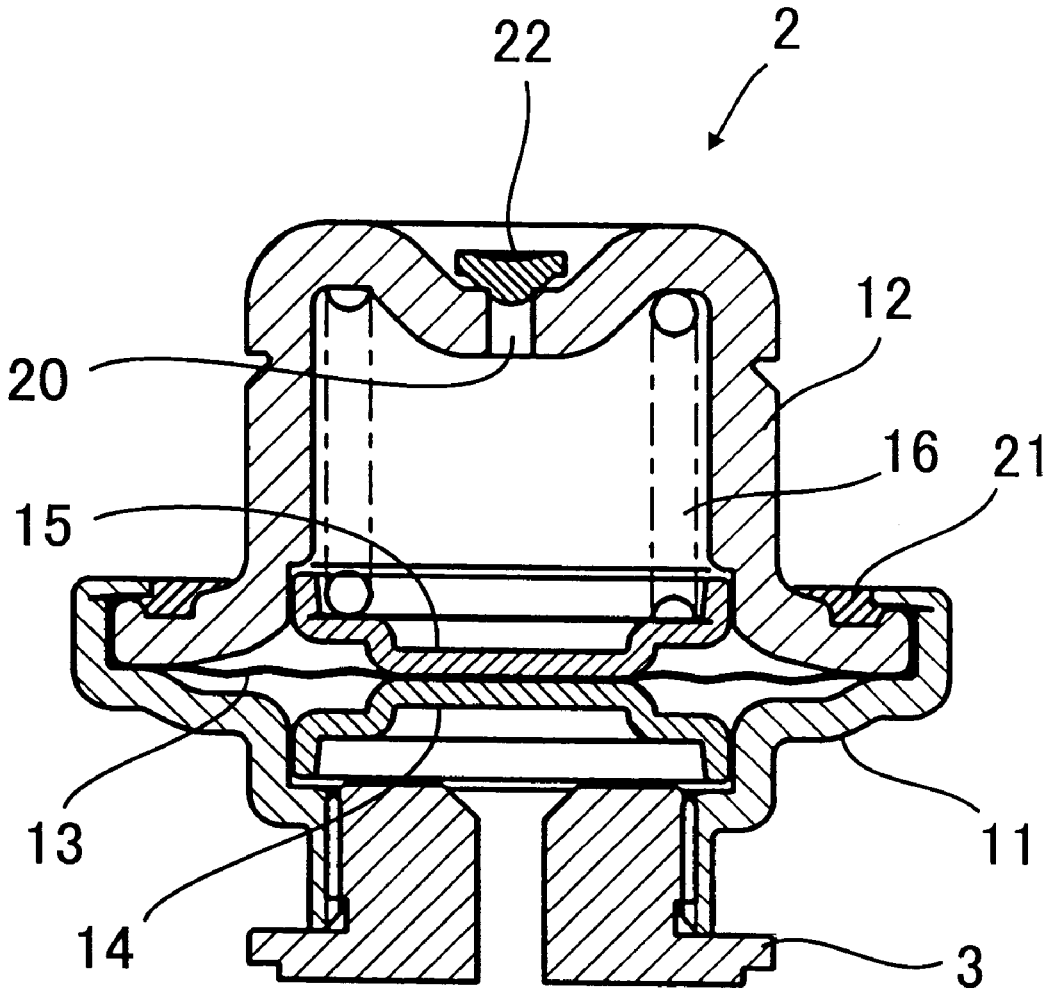
FIG. 1 is a cross-sectional view of a power element of a control valve for a variable capacity compressor, according to a first embodiment of the present invention.
Figure 7:
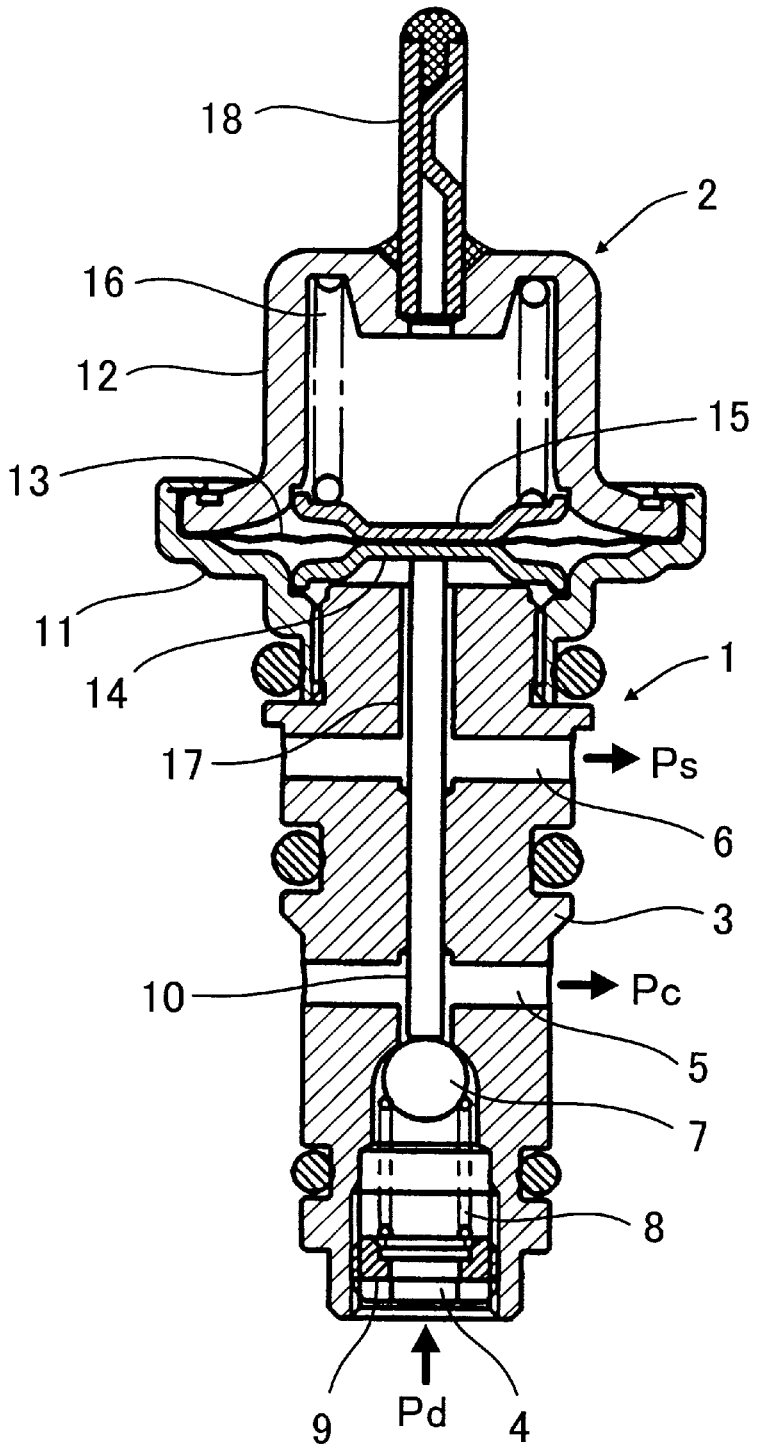
FIG. 7 PRIOR ART
FIG. 7 is a cross-sectional view showing an example of the construction of an internal variable control valve for a variable capacity compressor, which is manufactured by a conventional manufacturing method.

FIG. 1 is a cross-sectional view showing a power element of a control valve for a variable capacity compressor, according to a first embodiment of the invention. In FIG. 1, component parts and elements corresponding to those appearing in FIG. 7 are designated by identical reference numerals, and detailed description thereof is omitted.

First, the power element 2 to be attached to a valve 1 is assembled in the atmospheric air. More specifically, a disk 14, a diaphragm 13, a disk 15 and a spring 16 are arranged in a lower housing 11 to be combined with a body 3 of the valve 1, and an upper housing 12 formed with a small hole 20 is placed upon the lower housing 11. In a state of the diaphragm 13 being sandwiched between the periphery of the upper housing 12 and the inner wall surface of the lower housing 11, the periphery of the lower housing 11 is joined to the upper housing 12 by caulking, and then the junction of the upper and lower housings 11, 12 is sealed by solder 21.

Then, the power element 2 thus assembled is placed in a vacuum container and the vacuum container is evacuated. Thereafter, the small hole formed through the upper housing is subjected to spot welding in a vacuum atmosphere atmosphere. As a result, the small hole 20 is sealed by a weld metal 22, whereby a chamber defined by the upper housing 12 and the diaphragm 13 can be formed as a vacuum chamber.

Figure 2:
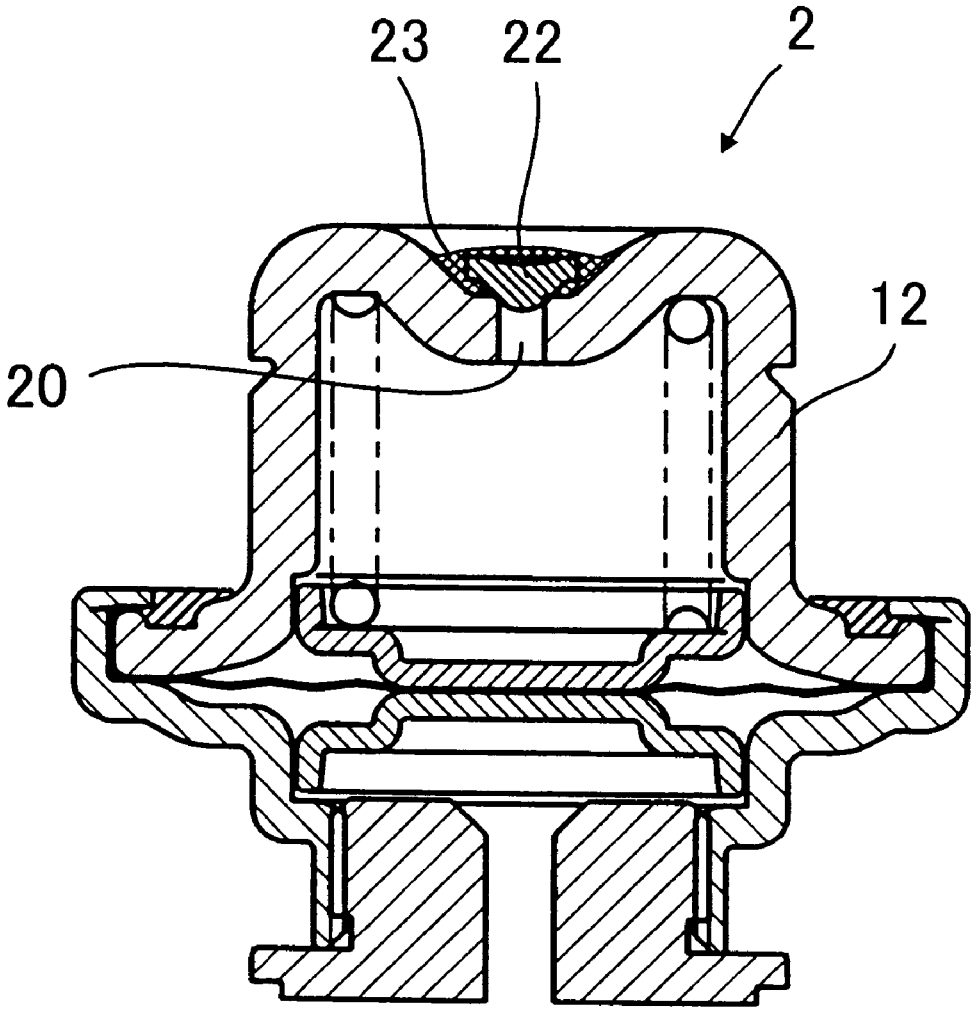
FIG. 2 is a cross-sectional view of a power element of a control valve for a variable capacity compressor, according to a second embodiment of the present invention.

FIG. 2 is a cross-sectional view showing a power element of a control valve for a variable capacity compressor, according to a second embodiment of the invention. In FIG. 2, component parts and elements corresponding to those appearing in FIG. 1 are designated by identical reference numerals, and detailed description thereof is omitted.

The present embodiment is similar to the first embodiment in the steps from the assembly of the power element 2 in the atmospheric air to the sealing of the small hole 20 by spot welding in a vacuum atmosphere atmosphere.

In the second embodiment, after completion of the spot welding of the small hole 20 in the vacuum atmosphere atmosphere, the power element 2 is taken out from the vacuum container, and then the spot-welded portion is soldered in the atmospheric air. As a result, the weld metal is covered with solder 23, which makes sealing of the small hole 20 more reliable.

Figure 3:
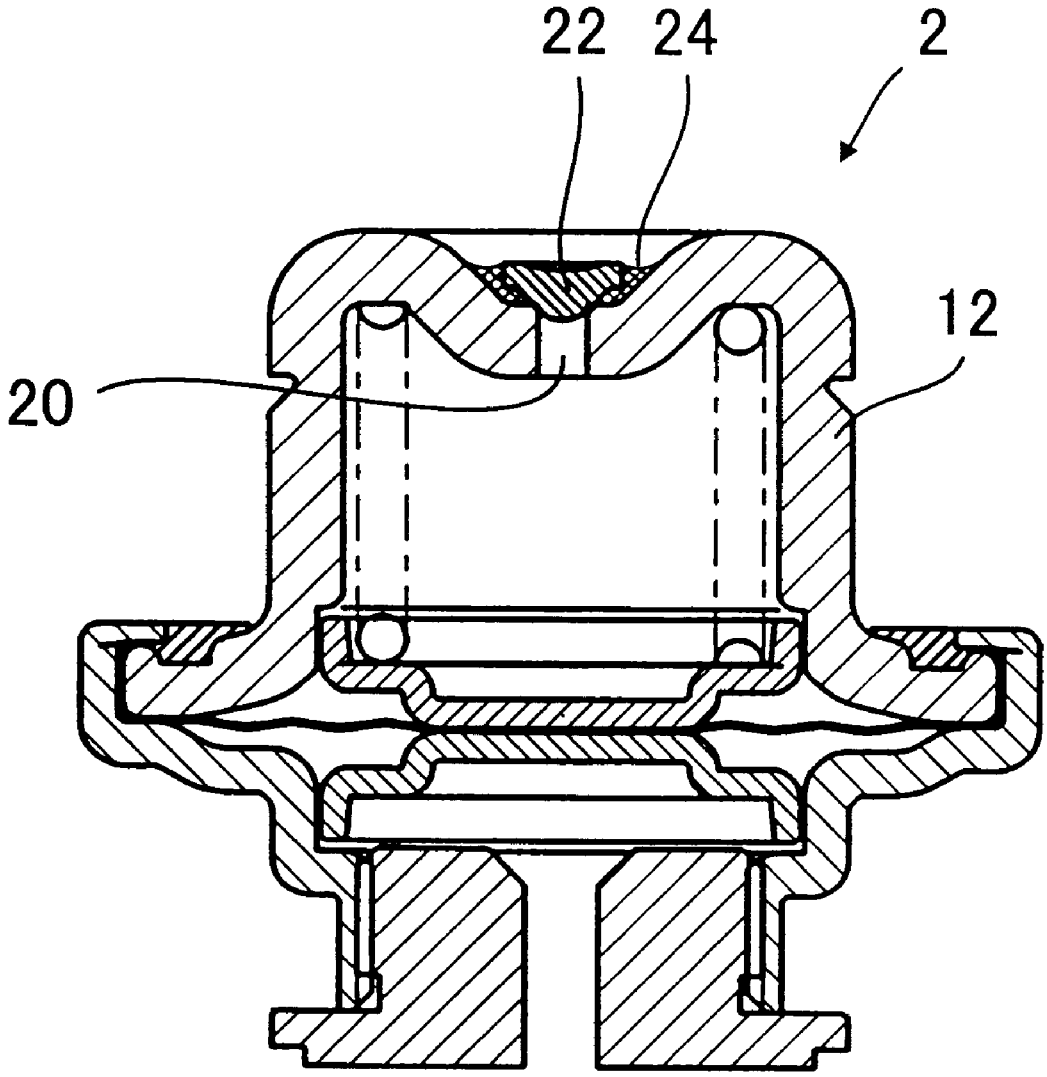
FIG. 3 is a cross-sectional view of a power element of a control valve for a variable capacity compressor, according to a third embodiment of the present invention.

FIG. 3 is a cross-sectional view showing a power element of a control valve for a variable capacity compressor, according to a third embodiment of the invention. In FIG. 3, component parts and elements corresponding to those appearing in FIG. 1 are designated by identical reference numerals, and detailed description thereof is omitted.

The present embodiment is similar to the first embodiment in the steps from the assembly of the power element 2 in the atmospheric air to the sealing of the small hole 20 by spot welding in a vacuum atmosphere.

In the third embodiment, after completion of the spot welding of the small hole 20 in the vacuum atmosphere, the power element 2 is taken out from the vacuum container, and finally, an anticorrosive 24 is applied to the spot-welded portion in the atmospheric air.

Figure 4:
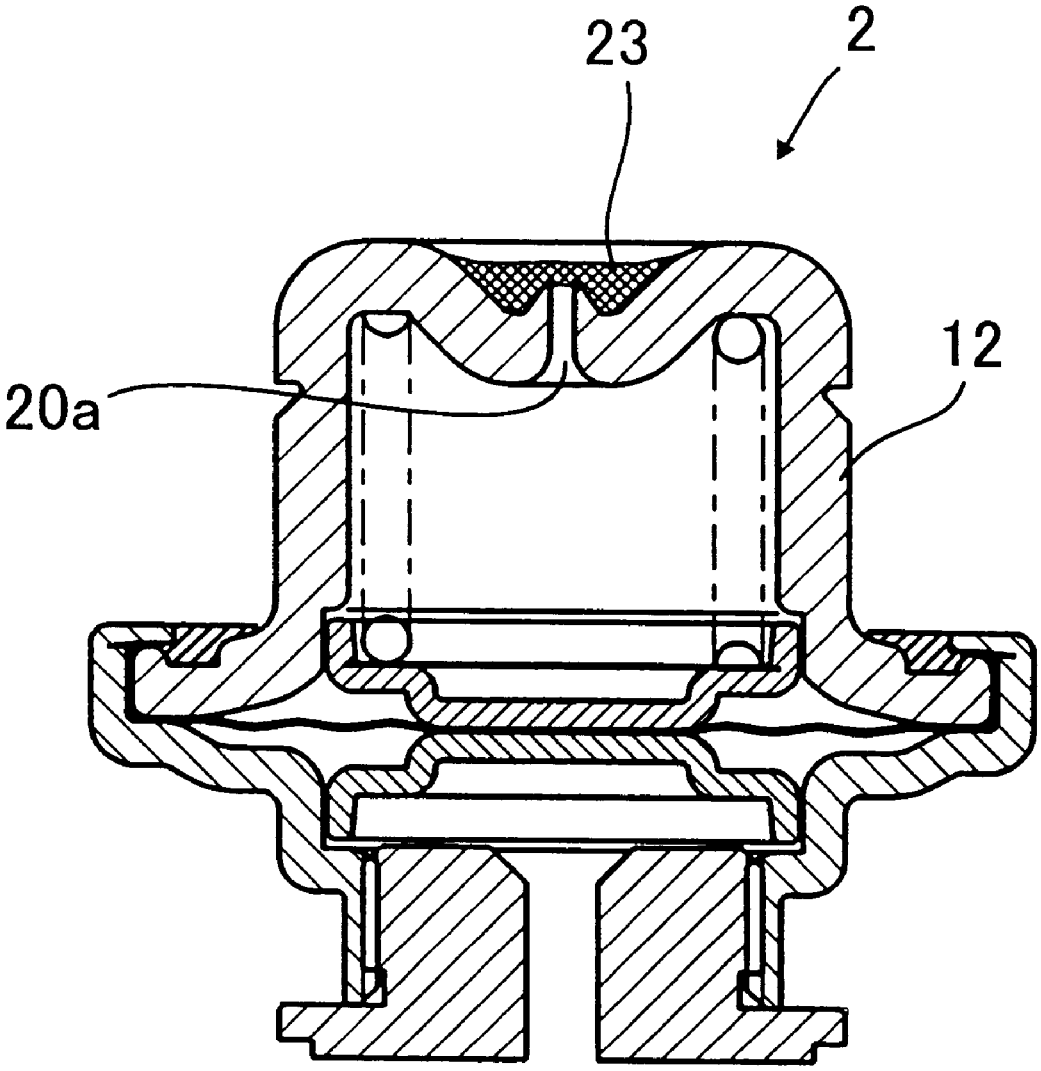
FIG. 4 is a cross-sectional view of a power element of a control valve for a variable capacity compressor, according to a fourth embodiment of the present invention.

FIG. 4 is a cross-sectional view showing a power element of a control valve for a variable capacity compressor, according to a fourth embodiment of the invention. In FIG. 4, component parts and elements corresponding to those appearing in FIG. 1 are designated by identical reference numerals, and detailed description thereof is omitted.

The present embodiment employs an upper housing 12 formed with a small hole 20*a* having a periphery with burrs protruding outward which are formed when the hole 20*a* is formed.

A power element 2 is assembled in the atmospheric air by using the upper housing 12 formed with the burred small hole 20*a*. The power element 2 is placed in a vacuum container, and then the vacuum container is evacuated. Thereafter, the burred small hole 20*a* of the upper housing 12 is soldered in a vacuum atmosphere, whereby the hole 20*a* is sealed by a solder 23.

Figure 5:
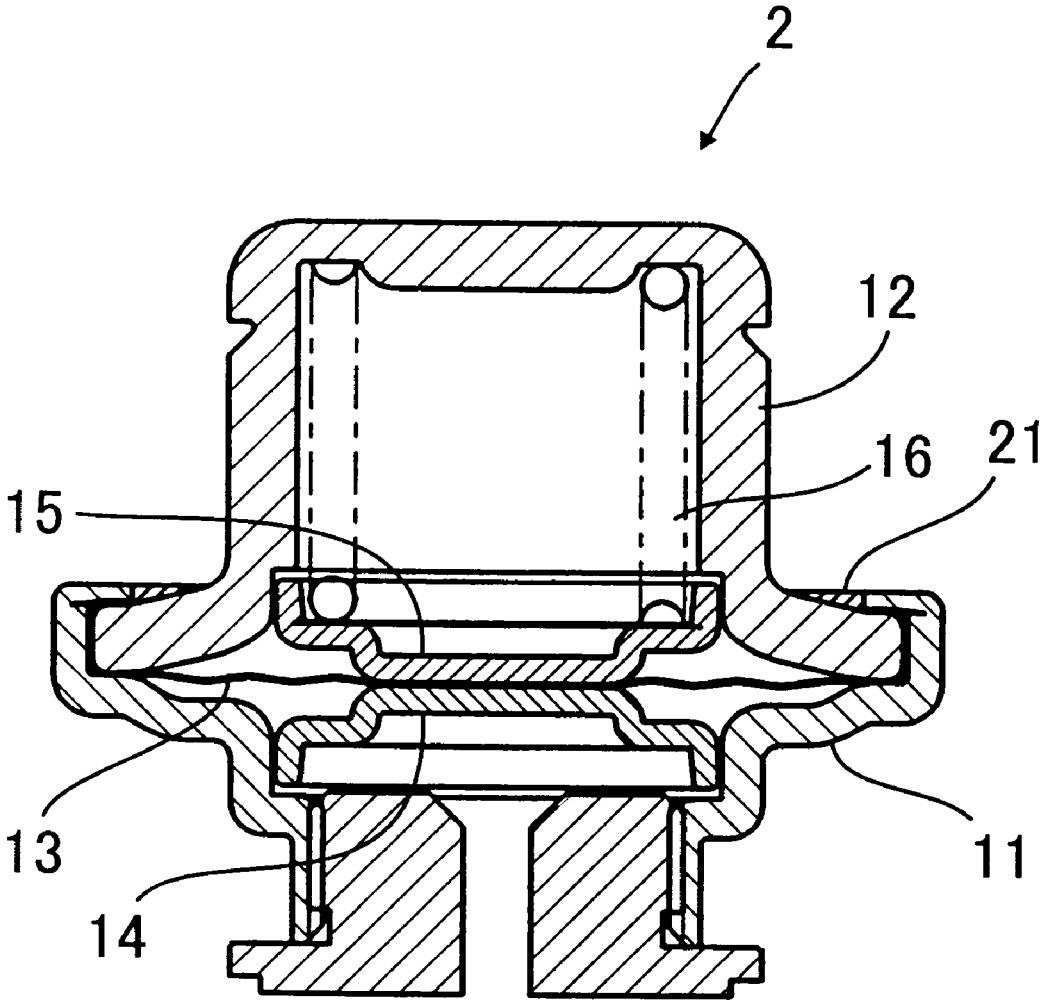
FIG. 5 is a cross-sectional view of a power element of a control valve for a variable capacity compressor, according to a fifth embodiment of the present invention.

FIG. 5 is a cross-sectional view showing a power element of a control valve for a variable capacity compressor, according to a fifth embodiment of the invention. In FIG. 5, component parts and elements corresponding to those appearing in FIG. 1 are designated by identical reference numerals, and detailed description thereof is omitted.

In the present embodiment, a power element 12 is assembled in a vacuum atmosphere by employing an upper housing 12 which is not formed with a small hole.

A disk 14, a diaphragm 13, a disk 15 and a spring 16 are arranged in a lower housing 11, and the upper housing 12 is placed upon the lower housing 11. Then, the assembled power element 12 is placed in a vacuum container, and the vacuum container is evacuated. Thereafter, the periphery of the lower housing 11 is caulked to the periphery of the upper housing 12 whereby the upper and lower housings 11, 12 are joined to each other, and then the junction of the upper and lower housings 11, 12 is sealed by solder 21. The sealing step carried out in the vacuum atmosphere enables a chamber defined by the upper housing 12 and the diaphragm 13 to be formed as a vacuum chamber.

Figure 6:
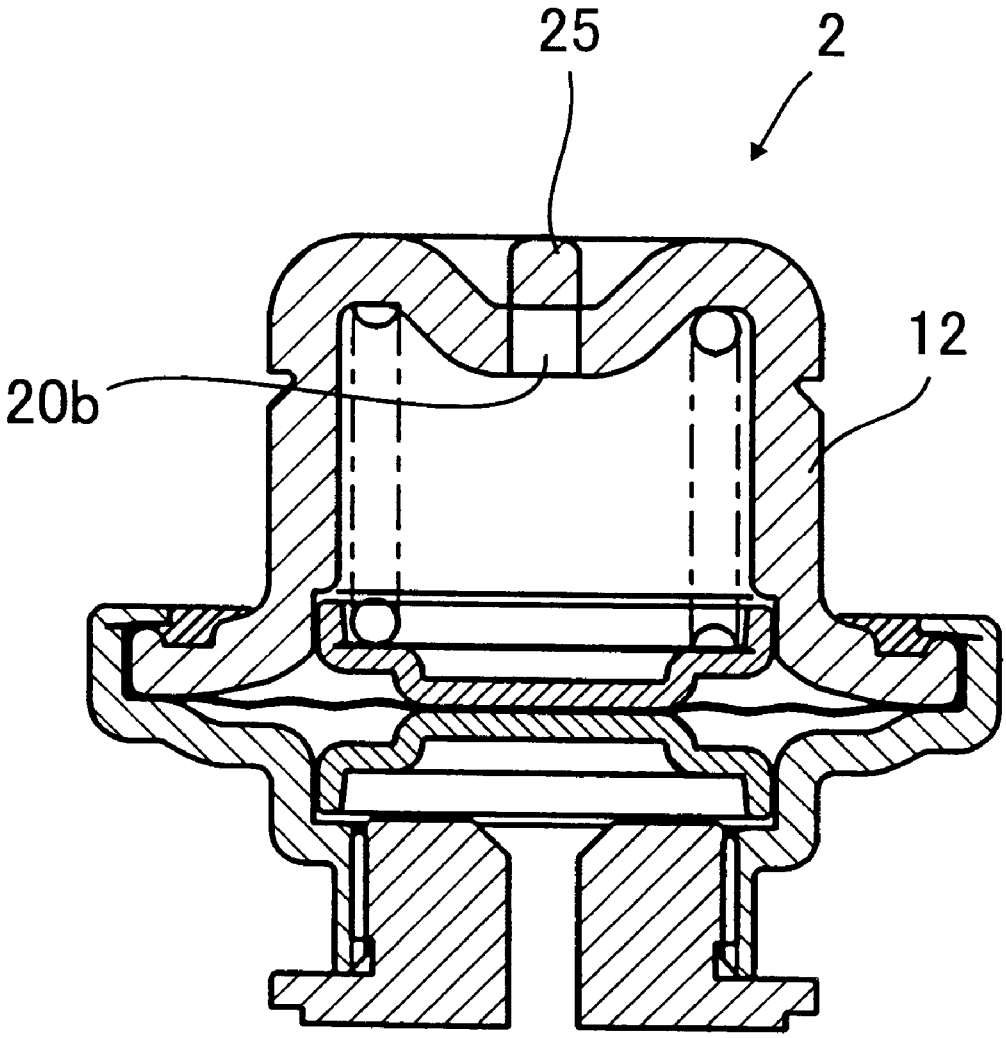
FIG. 6 is a cross-sectional view of an unsealed power element of a control valve for a variable capacity compressor, according to sixth to eighth embodiments of the present invention.

FIG. 6 is a cross-sectional view showing an unsealed state of a power element of a control valve for a variable capacity compressor, according to sixth to eighth embodiments of the invention. In FIG. 6, component parts and elements corresponding to those appearing in FIG. 1 are designated by identical reference numerals, and detailed description thereof is omitted.

The sixth to eighth embodiments employ an upper housing 12 formed with a half pierce 20*b* in which a blanked portion 25 formed by half punching remains partially connected to the upper housing 12 without being separated therefrom.

First, in the sixth embodiment, the power element is assembled in the atmospheric air by using the upper housing 12 formed with the half pierce 20*b*. Then, the assembled power element is placed in a vacuum container, and the vacuum container is evacuated. Thereafter, the half pierce 20*b* of the upper housing 12 is soldered in the vacuum atmosphere, whereby the half pierce 20*b* is sealed.

In the seventh embodiment, the power element is assembled in the atmospheric air by using the upper housing 12 formed with the half pierce 20*b*. Then, the assembled power element is placed in a vacuum container, and the vacuum container is evacuated. Thereafter, the half pierce 20*b* is subjected to arc welding in the vacuum atmosphere, whereby the blank 25 is welded to the base material of the upper housing 12 to seal the half pierce 20*b*.

In the eighth embodiment, the power element is assembled in the atmospheric air by using the upper housing 12 formed with the half pierce 20*b*. Then, the assembled power element is placed in a vacuum container, and the vacuum container is evacuated. Thereafter, the half pierce 20*b* is subjected to laser welding in the vacuum atmosphere, whereby the blank 25 is welded to the base material of the upper housing 12 to seal the half pierce 20*b*.

As described above, according to the present invention, an upper housing forming a vacuum chamber is sealed in a vacuum atmosphere. Therefore, it is not required to use a capillary tube for evacuation, and hence the vacuum chamber can be formed through a reduced number of steps. Further, the number of component parts and elements of the control valve for a variable capacity compressor can be reduced, which makes it possible to decrease the number of leaky portions, thereby improving a vacuum-maintaining capability of the control valve.

The foregoing is considered as illustrative only of the principles of the present invention. Further, since numerous modifications and changes will readily occur to those skilled in the art, it is not desired to limit the invention to the exact construction and applications shown and described, and accordingly, all suitable modifications and equivalents may be regarded as falling within the scope of the invention in the appended claims and their equivalents.

What is claimed is:

1. A method of forming a vacuum chamber of a control valve for a variable capacity compressor, said control valve having a pressure-sensitive member separating said vacuum chamber from another chamber, said pressure-sensitive member controlling an opening degree of said control valve in response to suction pressure of said variable capacity compressor introduced into said another chamber, the method comprising the steps of:

joining a periphery of a first housing formed with a small hole and defining said vacuum chamber and a periphery of a second housing to be combined with a valve to each other by caulking, and then brazing a junction of said peripheries; and sealing said small hole in a vacuum atmosphere.

2. A method of forming a vacuum chamber of a control valve for a variable capacity compressor, according to claim 1, wherein said sealing is performed by spot welding.

3. A method of forming a vacuum chamber of a control valve for a variable capacity compressor, according to claim 2, wherein after completion of said spot welding, said sealed portion is brazed in the atmospheric air.

4. A method of forming a vacuum chamber of a control valve for a variable capacity compressor, according to claim 2, wherein after completion of said spot welding, an anti-corrosive is applied to said sealed portion in the atmospheric air.

5. A method of forming a vacuum chamber of a control valve for a variable capacity compressor, according to claim 1, wherein said sealing is performed by vacuum brazing.

6. A method of forming a vacuum chamber of a control valve for a variable capacity compressor, said control valve having a pressure-sensitive member separating said vacuum chamber from another chamber, said pressure-sensitive member controlling an opening degree of said control valve in response to suction pressure of said variable capacity compressor introduced into said another chamber, the method comprising the step of:

joining a periphery of a first housing defining said vacuum chamber and a periphery of a second housing to be combined with a valve to each other, by caulking in a vacuum atmosphere, and then brazing a junction of said peripheries.

7. A method of forming a vacuum chamber of a control valve for a variable capacity compressor, said control valve having a pressure-sensitive member separating said vacuum chamber from another chamber, said pressure-sensitive member controlling an opening degree of said control valve in response to suction pressure of said variable capacity compressor introduced into said another chamber, the method comprising the steps of:

joining a periphery of a first housing formed with a half pierce and defining said vacuum chamber and a periphery of a second housing to be combined with a valve to each other by caulking, and then brazing a junction of said peripheries; and sealing said half pierce by brazing in a vacuum atmosphere.

8. A method of forming a vacuum chamber of a control valve for a variable capacity compressor, said control valve having a pressure-sensitive member separating said vacuum chamber from another chamber, said pressure-sensitive member controlling an opening degree of said control valve in response to suction pressure of said variable capacity compressor introduced into said another chamber, the method comprising the steps of:

joining a periphery of a first housing formed with a half pierce and defining said vacuum chamber and a periphery of a second housing to be combined with a valve to each other by caulking, and then brazing a junction of said peripheries; and sealing said half pierce by base metal welding in a vacuum atmosphere.

9. A method of forming a vacuum chamber of a control valve for a variable capacity compressor, according to claim 8, wherein said base metal welding is performed by arc welding.

10. A method of forming a vacuum chamber of a control valve for a variable capacity compressor, according to claim 8, wherein said base metal welding is performed by laser welding.

* * * * *

UNITED STATES PATENT AND TRADEMARK OFFICE

CERTIFICATE OF CORRECTION

PATENT NO. : 6,543,672 B2 
DATED : April 8, 2003
INVENTOR(S) : Hisatoshi Hirota, Shinji Saeki and Kouji Habu It is certified that error appears in the above-identified patent and that said Letters Patent is hereby corrected as shown below:

Title page,
Item [75], Inventors, replace "Shiniji Saeki, Tokyo (JP)" with -- Shinji Saeki, Tokyo (JP) --.

Signed and Sealed this

Tenth Day of June, 2003

JAMES E. ROGAN
*Director of the United States Patent and Trademark Office*